US007730914B2

(12) United States Patent
Lin

(10) Patent No.: US 7,730,914 B2
(45) Date of Patent: Jun. 8, 2010

(54) FEEDING MECHANISM FOR A WOODWORKING MACHINE

(76) Inventor: Chin-Chi Lin, No. 473, Sanfong Road, Houli Township, Taichung County (TW)

( * ) Notice: Subject to any disclaimer, the term of this patent is extended or adjusted under 35 U.S.C. 154(b) by 214 days.

(21) Appl. No.: 12/134,662

(22) Filed: Jun. 6, 2008

(65) Prior Publication Data

US 2009/0133779 A1 May 28, 2009

(30) Foreign Application Priority Data

Nov. 23, 2007 (TW) ..... 96144547 A

(51) Int. Cl.
*B27B 31/00* (2006.01)
*B27C 1/12* (2006.01)

(52) U.S. Cl. ..... 144/242.1; 144/245.2; 144/253.6; 198/608; 83/412

(58) Field of Classification Search ..... 144/242.1, 144/245.1, 245.2, 250.17, 253.1, 253.6, 253.7, 144/253.9; 198/608, 611, 612; 83/409, 412
See application file for complete search history.

(56) References Cited

U.S. PATENT DOCUMENTS 2,722,247 A * 11/1955 Schroeder et al. ..... 83/446
6,578,461 B1 * 6/2003 Loo ..... 83/423
7,341,081 B1 * 3/2008 Villiger ..... 144/253.8

* cited by examiner

*Primary Examiner*—Shelley Self
(74) *Attorney, Agent, or Firm*—Occhiuti Rohlicek & Tsao LLP

(57) ABSTRACT

A feeding mechanism is adapted for use with a woodworking machine. The feeding mechanism includes a rail unit adapted to be disposed on two sides of a worktable, a feeding unit, and a press roller unit. The feeding unit includes a slidable body adapted to extend across the worktable and disposed slidably on the rail unit, two spaced apart rollers disposed on the slidable body, a belt component trained on the rollers, and a driving component for driving the rollers to rotate along with the belt component. The press roller unit is adapted to extend slidably across the worktable and includes a slidable seat disposed slidably on the rail unit, a press roller connected pivotally to the slidable seat, and a resilient component adapted for biasing the press roller to press the workpiece against the feeding unit.

12 Claims, 10 Drawing Sheets

FEEDING MECHANISM FOR A WOODWORKING MACHINE

CROSS-REFERENCE TO RELATED APPLICATION

This application claims priority of Taiwanese Application No. 096144547, filed on Nov. 23, 2007.

BACKGROUND OF THE INVENTION

1. Field of the Invention

The invention relates to a feeding mechanism, more particularly to a feeding mechanism for a woodworking machine.

2. Description of the Related Art

FIGS. 1 and 2 illustrate a woodworking machine that comprises a worktable 1 for supporting a workpiece 103 thereon and having a workpiece feeding side 101 and a workpiece discharge side 102 opposite to the workpiece feeding side 101, a pair of parallel slide rails 2 disposed respectively on the workpiece feeding side 101 and the workpiece discharge side 102 of the worktable 1, a cutter 3 provided on the worktable 1, a fence 4 extending across the worktable 1 and slidable along the slide rails 2, and a conventional feeder 5 mounted on the worktable 1. The fence 4 has an abutment surface 401 that permits the workpiece 103 to abut thereagainst. The conventional feeder 5 includes a support stand 6 mounted securely on the worktable 1 and disposed at one side of the fence 4, a horizontal arm 7 extending from a top end of the supporting stand 6, a vertical arm 8 connected to one end of the horizontal arm 7 opposite to the supporting stand 6, and a driving unit 9 connected to the vertical arm 8. The driving unit 9 includes a housing 901, a plurality of feeding rollers 903 disposed in the housing 901, and a motor 902 for driving the feeding rollers 903 to rotate. When the woodworking machine is in use, the workpiece 103 is placed on the worktable 1 with a side surface thereof abutting against the abutment surface 401 of the fence 4 and a top surface thereof being in frictional contact with the feeding rollers 903 of the driving unit 9, and the feeding rollers 903 are driven to rotate to thereby move the workpiece 103 on the worktable 1 from the workpiece feeding side 101 toward the workpiece discharge side 102.

However, since the driving unit 9 of the feeding unit 5 is relatively heavy, the supporting stand 6 and therefore the part of the worktable 1 connected to the supporting stand 6 have a tendency to be pulled upwardly by the driving unit 9 via the horizontal arm 7. Such tendency may result in inclination of the worktable 1. Moreover, since the supporting stand 6 is fixed on the worktable 1, the distance travelled by is limited.

SUMMARY OF THE INVENTION

Therefore, the object of the present invention is to provide a feeding mechanism for a woodworking machine that can overcome the above-mentioned disadvantages associated with the prior art.

Accordingly, a feeding mechanism of the present invention is adapted for use with a woodworking machine. The woodworking machine includes a worktable that is disposed for supporting a workpiece thereon and that has a workpiece feeding side and a workpiece discharge side opposite to the workpiece feeding side, and a cutter that is provided on the worktable between the workpiece feeding side and the workpiece discharge side. The feeding mechanism includes a rail unit, a feeding unit, and a press roller unit. The rail unit is adapted to be disposed on the workpiece feeding side and the workpiece discharge side of the worktable and extends along a first direction. The feeding unit includes a slidable body that is adapted to extend across the worktable in a second direction transverse to the first direction, that is disposed slidably on the rail unit, and that has an abutment surface adapted to be perpendicular to the worktable and extending in the second direction, two rollers that are disposed on the slidable body and that are spaced apart from each other in the second direction, a belt component that is trained on the rollers and that abuts against the abutment surface of the slidable body, and a driving component that is disposed for driving the rollers to rotate along with the belt component. The press roller unit is adapted to extend slidably across the worktable in the second direction and includes a slidable seat that is disposed slidably on the rail unit, a press roller that is connected pivotally to the slidable seat, and a resilient component that is adapted for biasing the press roller to press the workpiece against the feeding unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
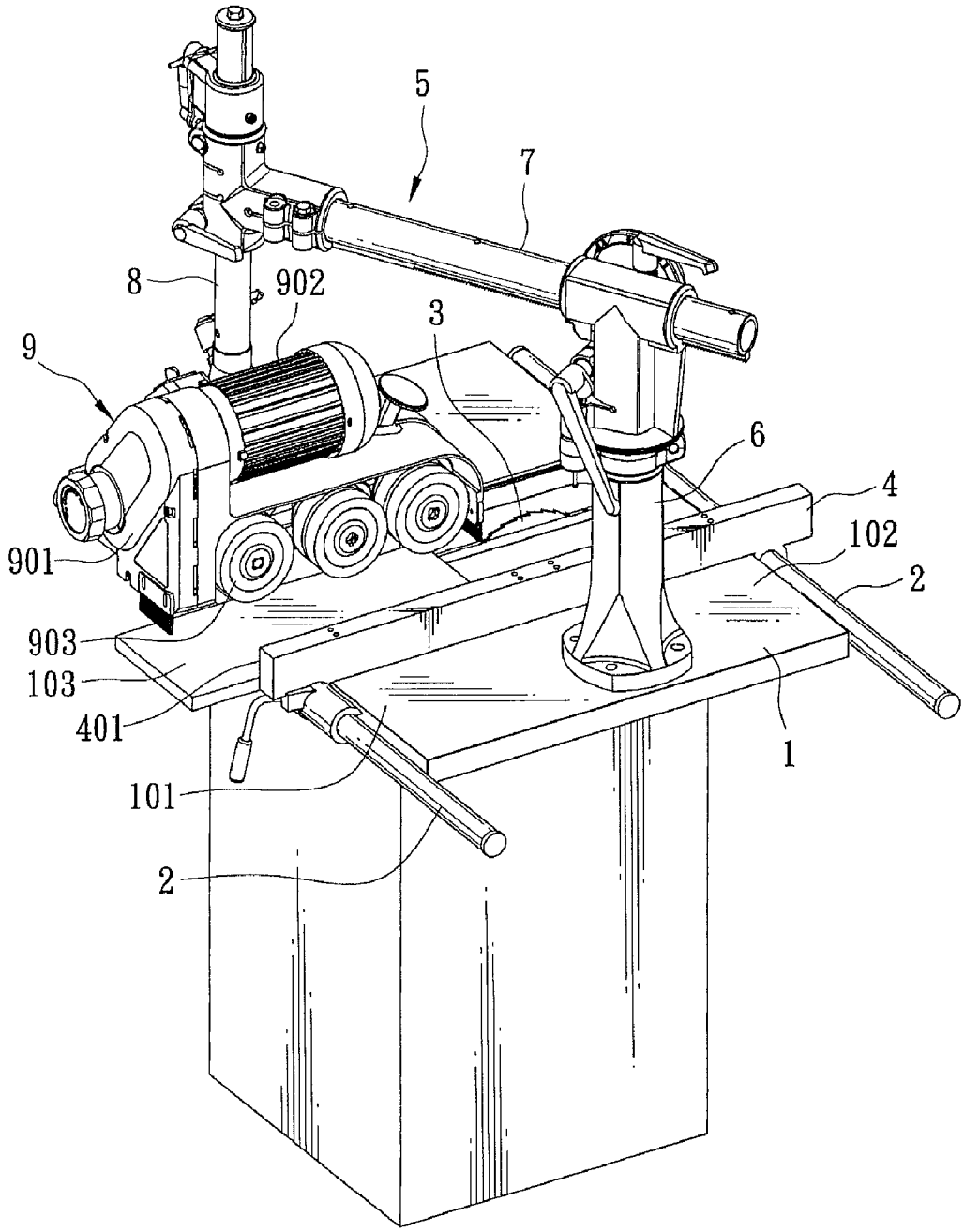
FIG. 1 PRIOR ART
FIG. 1 is a perspective view of a woodworking machine mounted with a conventional feeder.
Figure 2:
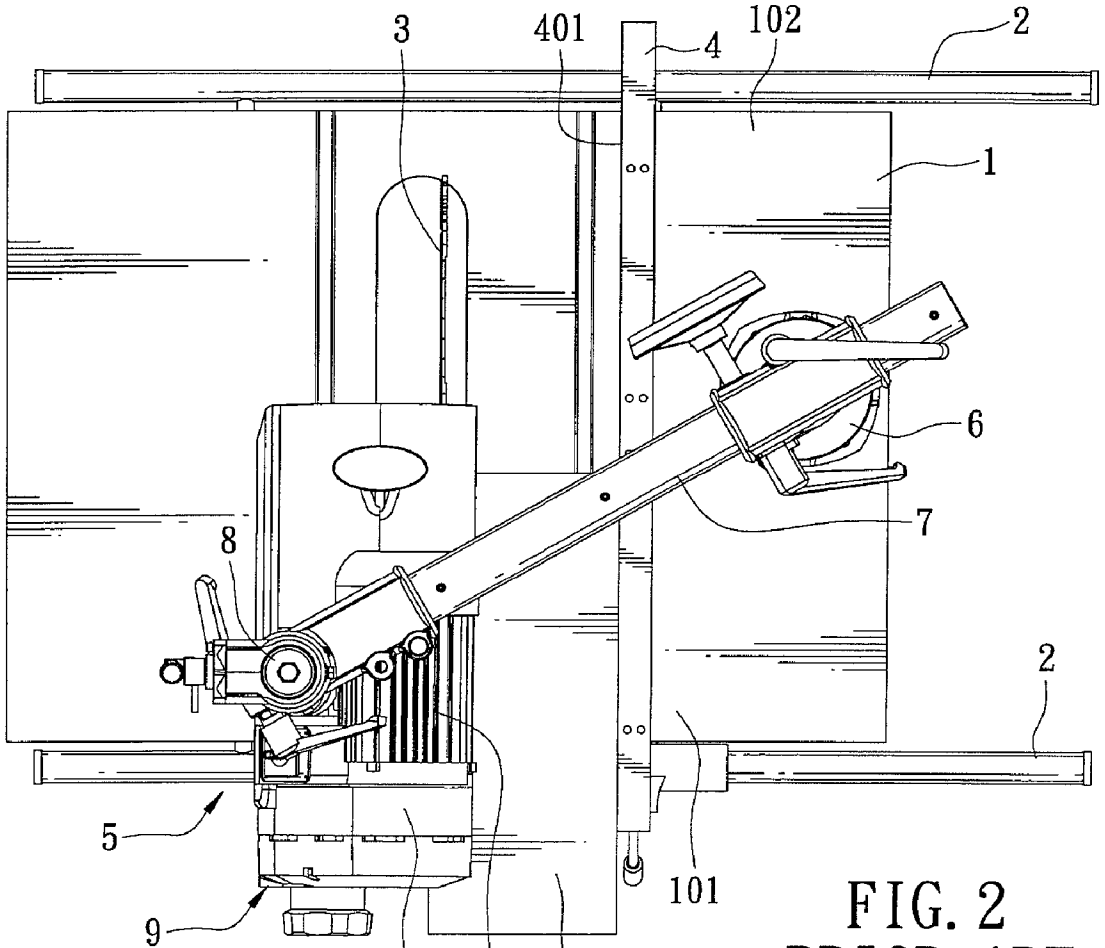
FIG. 2 PRIOR ART
FIG. 2 is top view of the woodworking machine of FIG. 1.

Before the present invention is described in greater detail, it should be noted that like elements are denoted by the same reference numerals throughout the disclosure.

Figure 3:
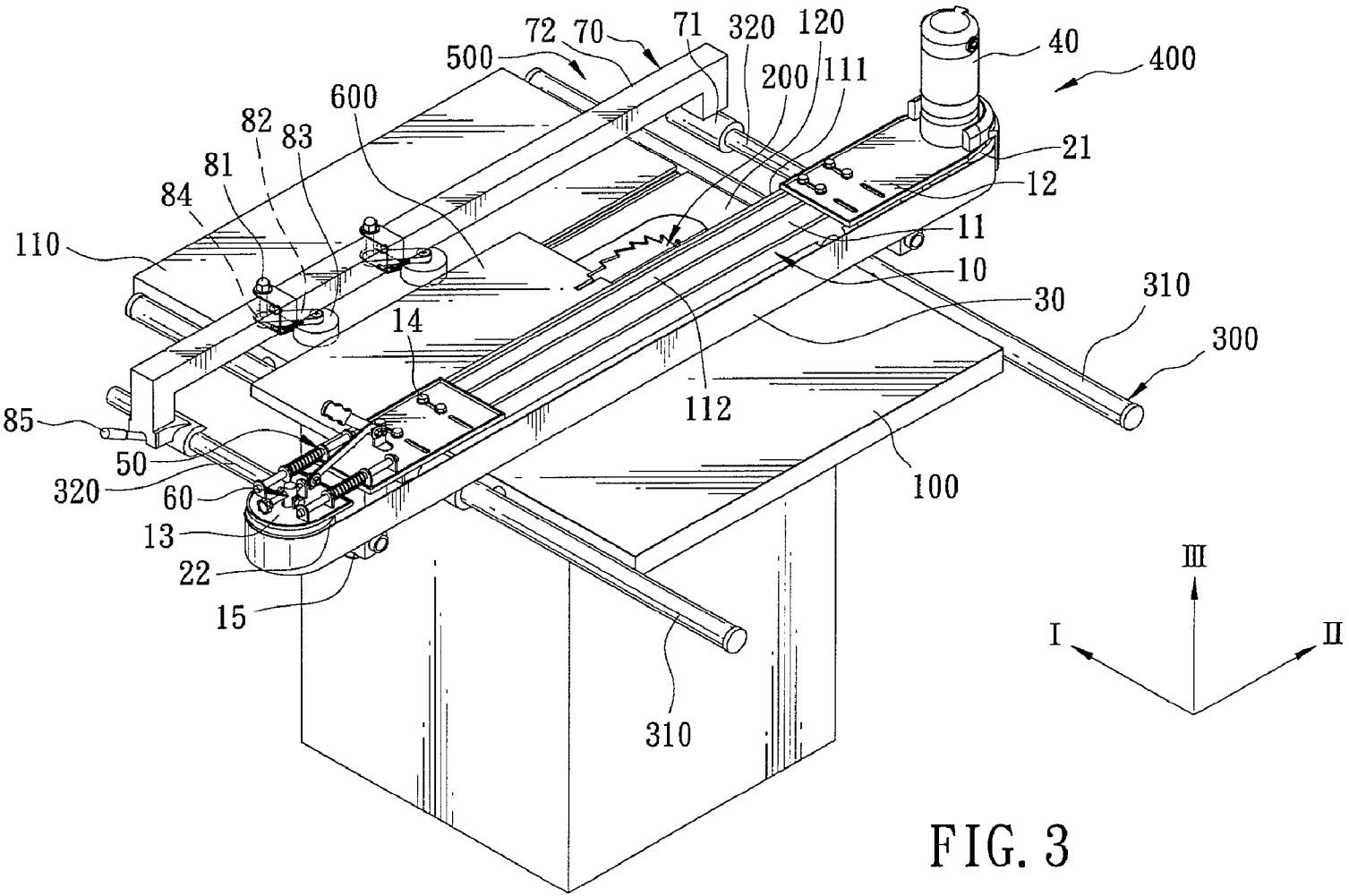
FIG. 3 is a perspective view of a woodworking machine mounted with a first preferred embodiment of a feeding mechanism according to the invention.
Figure 4:
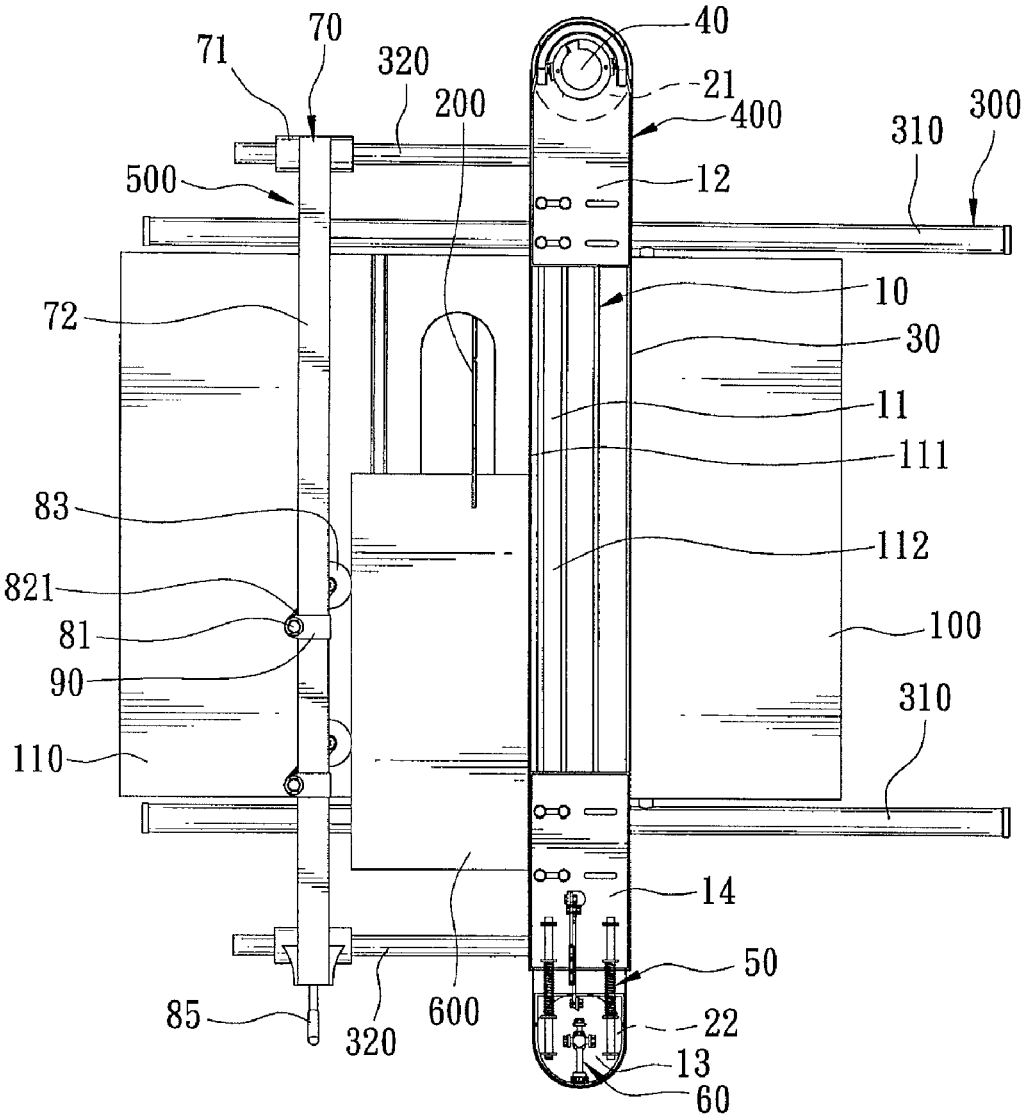
FIG. 4 is a top view of the first preferred embodiment.
Figure 5:
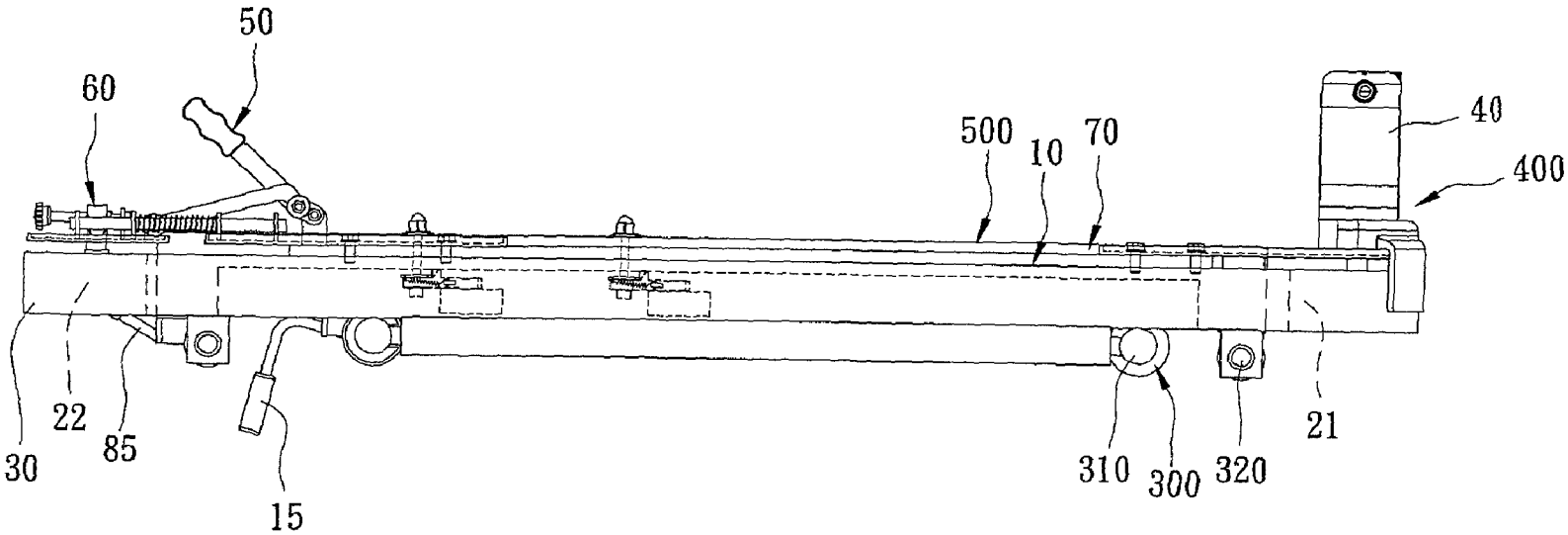
FIG. 5 is a side view of the first preferred embodiment.

As shown in FIGS. 3 to 5, the first preferred embodiment of a feeding mechanism according to the present invention is adapted for use with a woodworking machine, such as a table saw machine. The woodworking machine includes a worktable 100 that is disposed for supporting a workpiece 600 thereon and that has a workpiece feeding side 110 and a workpiece discharge side 120 opposite to the workpiece feeding side 110, and a cutter 200 that is in a form of a circular saw and that is provided on the worktable 100 between the workpiece feeding side 110 and the workpiece discharge side 120. The feeding mechanism comprises a rail unit 300, a feeding unit 400, and a press roller unit 500.

The rail unit 300 includes a pair of parallel main rails 310 extending in a first direction (I) and adapted to be disposed respectively on the workpiece feeding side 110 and the workpiece discharge side 120 of the worktable 100 of the woodworking machine, and a pair of secondary slide rails 320 parallel to the main rails 310. The main rails 310 are located between the secondary rails 320. In this embodiment, each of the main and secondary rails 310, 320 has a round cross-section. However, the cross-section of each of the main and secondary rails 310, 320 should not be limited thereto. For example, each of the main rails 310 may have a rectangular cross-section while each of the secondary rails 320 may still have the round cross-section in other embodiments of this invention.

The feeding unit 400 includes a slidable body 10 that is adapted to extend across the worktable 100 of the woodworking machine in a second direction (II) transverse to the first direction (I) and that is disposed slidably on the main rails 310 of the rail unit 300, first and second rollers 21, 22 that are disposed on the slidable body 10 and that are spaced apart from each other in the second direction (II), a belt component 30 that is trained on the first and second rollers 21, 22, a driving component 40 that is disposed for driving the first and second rollers 21, 22 to rotate along with the belt component 30, a distance-adjusting unit 50 that is disposed on the slidable body 10, and an angle-adjusting unit 60 that is disposed on the slidable body 10.

The slidable body 10 of the feeding unit 400 includes an abutment plate 11, a first positioning plate 12 mounted securely on one end of the abutment plate 11 adjacent to the workpiece discharge side 120 of the worktable 100 of the woodworking machine, a second positioning plate 13 connected movably to the other end of the abutment plate 11 adjacent to the workpiece feeding side 110 of the worktable 100, a third positioning plate 14 spaced apart from the second positioning plate 13 and mounted securely on the end of the abutment plate 11 adjacent to the workpiece feeding side 110 of the worktable 100, and a locking handle 15 pivotable to lock the slidable body 10 on the main rails 310 of the rail unit 300 through operation of a cam mechanism (not shown). The abutment plate 11 has an abutment surface 111 adapted to be perpendicular to the worktable 100 and extending in the second direction (II), and a top surface 112 extending perpendicularly from a top edge of the abutment surface 111. The first and third positioning plates 12, 14 are mounted securely and respectively on the top surface 112 via screws. The secondary rails 320 of the rail unit 300 are connected securely and respectively to opposite ends of the slidable body 10.

The first and second rollers 21, 22 of the feeding unit 400 are disposed respectively on the first and second positioning plates 12, 13 of the slidable body 10 of the feeding unit 400. The first roller 21 is driven to rotate directly by the driving component 40. The second roller 22 has an axle 221 (see FIG. 6) extending through the second positioning plate 13.

In this embodiment, the belt component 30 of the feeding unit 400 is a conveyor belt that abuts against the abutment surface 111 of the abutment plate 11 of the slidable body 10 of the feeding unit 400.

Figure 6:
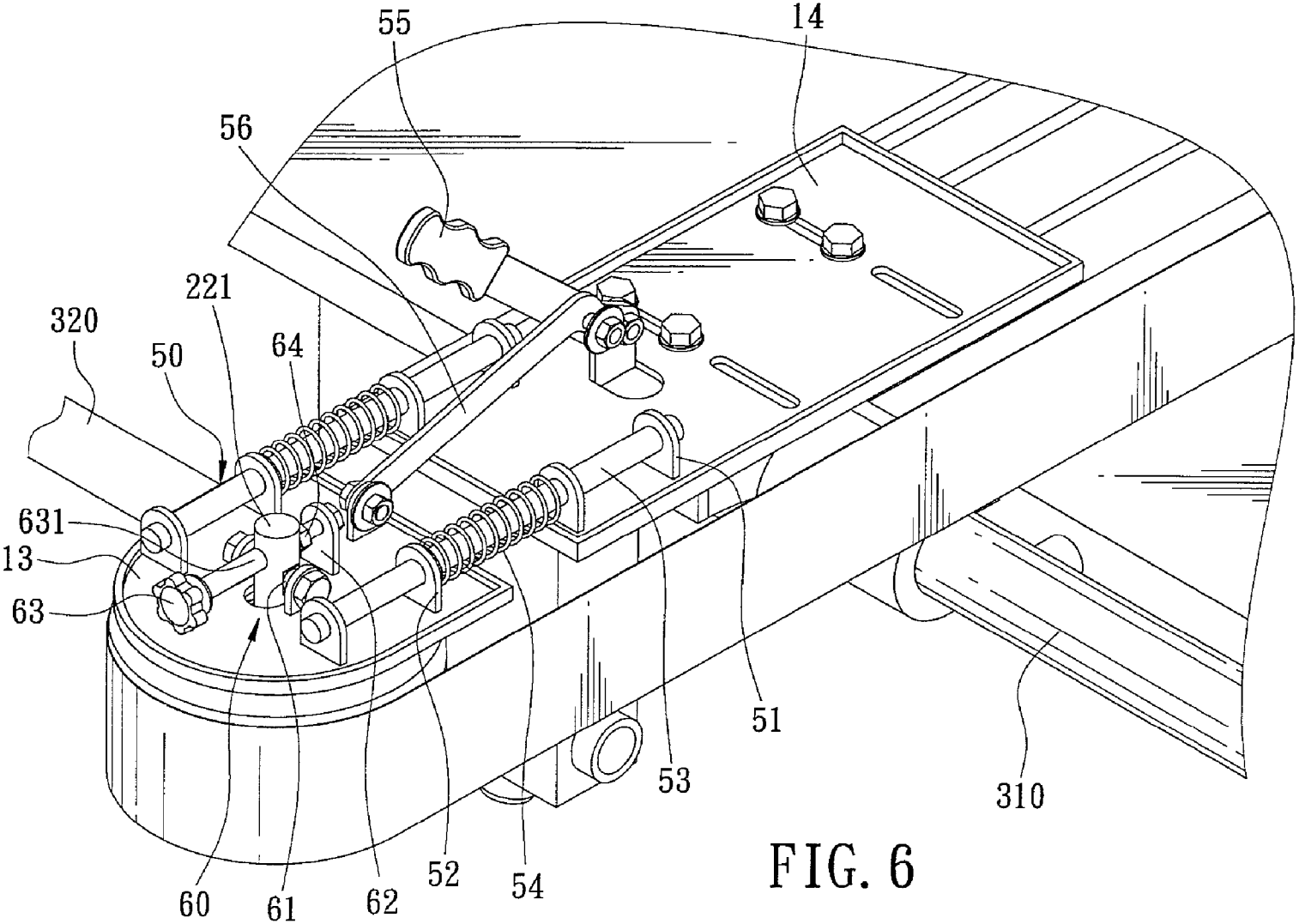
FIG. 6 is an enlarged fragmentary perspective view of a feeding unit of the first preferred embodiment.
Figure 8:
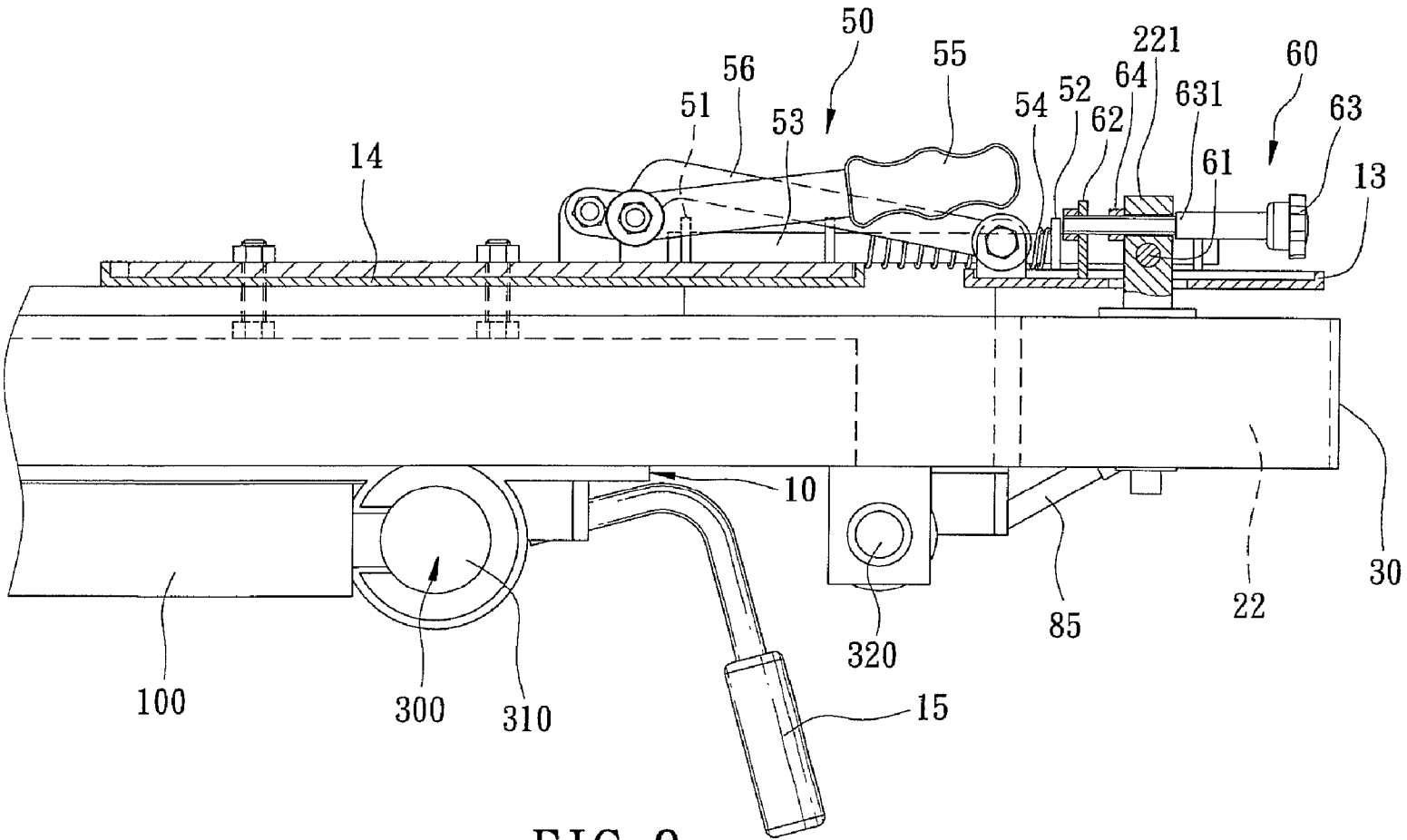
FIG. 8 is a fragmentary side view of the feeding unit of the first preferred embodiment, illustrating a distance-adjusting unit and an angle-adjusting unit.

As further shown in FIGS. 6 and 8, the distance-adjusting unit 50 is operable for driving movement of the second positioning plate 13 of the slidable body 10 of the feeding unit 400 relative to the third positioning plate 14 of the slidable body 10 in the second direction (II), and includes two pairs of first lugs 51, two pairs of second lugs 52, a pair of guide rods 53, a pair of springs 54, a handle rod 55, and a connecting rod 56. The first lugs 51 are provided on the third positioning plate 14. The second lugs 52 are provided on the second positioning plate 13 in such a manner that each pair of the second lugs 52 is registered with a respective pair of the first lugs 51 in the second direction (II). The guide rods 53 are disposed securely on the third positioning plate 14, with each of the guide rods 53 extending through a respective pair of the first lugs 51 and a corresponding pair of the second lugs 52. The springs 54 are sleeved respectively on the guide rods 53, with each of the springs 54 being disposed between a respective pair of the first lugs 51 and a corresponding pair of the second lugs 52. The handle rod 55 has an end connected pivotally to the third positioning plate 14. The connecting rod 56 has two ends connected respectively and pivotally to an intermediate portion of the handle rod 55 and the second positioning plate 13.

The angle-adjusting unit 60 has a pivot shaft 61 that is provided on the second positioning plate 13 of the slidable body 10 of the feeding unit 400 and that extends through a top end of the axle 221 of the second roller 22 of the feeding unit 400 in the first direction (I) such that the axle 221 is pivotable about the pivot shaft 61, a lug plate 62 that is disposed securely on the second positioning plate 13, and an adjusting screw rod 63 extending through and co-movable with an end of the axle 221 at a position above the pivot shaft 61 and extending through the lug plate 62. The adjusting screw rod 63 has a shoulder portion 631 adjacent to one side of the axle 221 that is opposite to the lug plate 62 in the second direction (II). The angle-adjusting unit 60 further has a nut 64 engaging threadedly the adjusting screw rod 63 and disposed adjacent to the other side of the axle 221 opposite to the shoulder portion 631 of the adjusting screw rod 63, such that the axle 221 is positioned between and close to the nut 64 and the shoulder portion 631 of the adjusting screw rod 63. Therefore, the top end of the axle 221 is co-movable with the adjusting screw rod 63 in the second direction (II). In other words, movement of the adjusting screw rod 63 relative to the lug plate 62 results in pivoting movement of the axle 221 about the pivot shaft 61. Due to the presence of the angle-adjustment unit 60, tilt adjustment of the second roller 22 relative to the second direction (II) is allowed.

Figure 7:
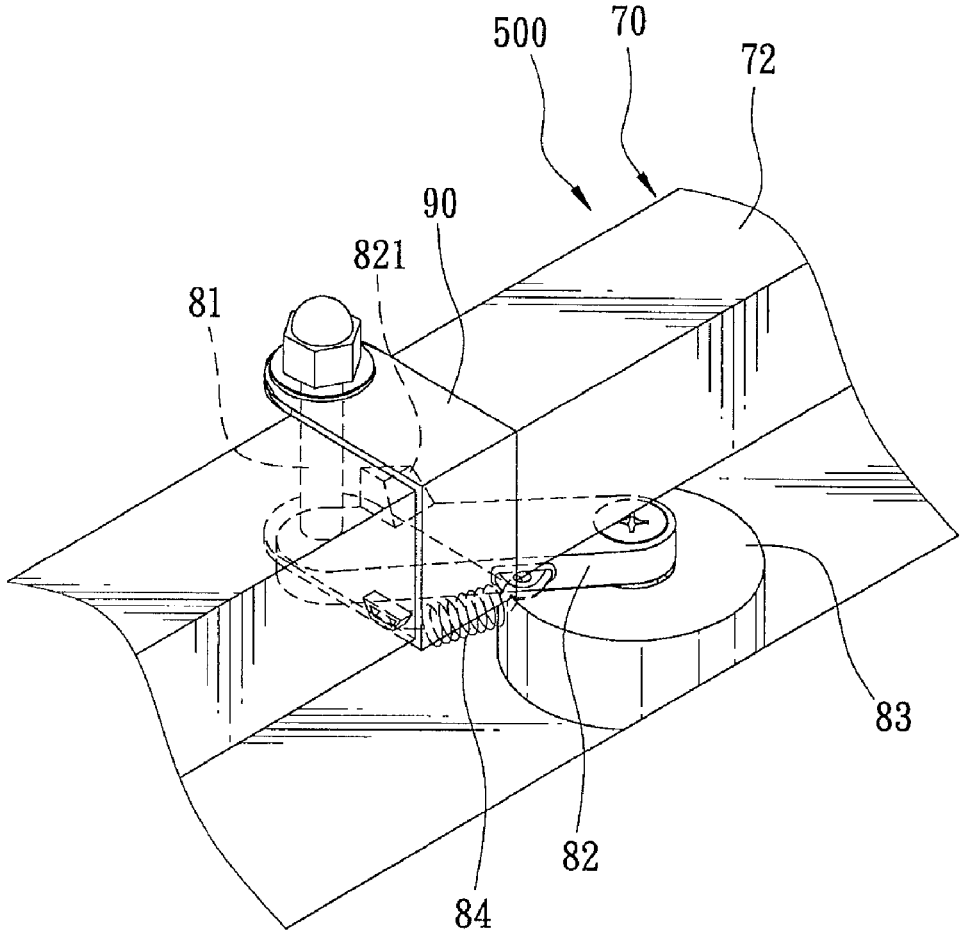
FIG. 7 is a fragmentary perspective view of a press roller unit of the first preferred embodiment.

As further shown in FIG. 7, in this embodiment, the press roller unit 500 is adapted to extend slidably across the worktable 100 in the second direction (II) and includes a slidable seat 70, a plurality of press rollers 83, a plurality of resilient components 84, a plurality of pivot rods 81, a plurality of connecting plates 82, a plurality of U-shaped fastening members 90, and a control handle 85.

The slidable seat 70 includes a pair of sleeves 71 sleeved respectively and movably on the secondary rails 320 of the rail unit 300, and a supporting arm 72 interconnecting fixedly the sleeves 71 and extending across the worktable 100. Each of the pivot rods 81 extends in a third direction (III) transverse to the first and second directions (I, II) and is connected to the supporting arm 72. Each of the connecting plates 82 has an end connected to and pivotable about a respective one of the pivot rods 81, and an opposite end connected pivotally to a respective one of the press rollers 83. Each of the fastening members 90 is sleeved fixedly on the supporting arm 72 and has two ends defining an opening through which a respective one of the pivot rods 81 extends. Each of the resilient components 84 is disposed between a respective one of the connecting plates 82 and a respective one of the fastening members 90, and is adapted for biasing a respective one of the press rollers 83 to press the workpiece 600 against the feeding unit 400. Each of the connecting plates 82 further has a stop portion 821 abutting against the supporting arm 72 for positioning the corresponding press roller 83 relative to the supporting arm 72 when the corresponding press roller 83 does not contact the workpiece 600. The control handle 85 is pivotable to lock the slidable seat 70 on the secondary rails 320 through operation of another cam mechanism (not shown).

As shown particularly in FIGS. 3, 4, 6, and 7, when use of the woodworking machine is desired, the driving component 40 of the feeding unit 400 is actuated to drive rotation of the belt component 30 of the feeding unit 400 around the first and second rollers 21, 22 of the feeding unit 400. Afterward, the workpiece 600 is first placed on the workpiece feeding side 110 of the worktable 100 of the woodworking machine with one side surface of the workpiece 600 being in frictional contact with the belt component 30. Next, the control handle 85 is operated, and the slidable seat 70 of the press roller unit 500 is moved along the secondary rails 320 of the rail unit 300 to press the press rollers 83 against the other side surface of the workpiece 600. Therefore, the workpiece 600 is confined between the belt component 30 and the press rollers 83, and is driven by the belt component 30 to move toward the workpiece discharge side 120 of the worktable 100 in the second direction (II) to be cut by the cutter 200. Since the press rollers 83 are pivotable respectively about the pivot shafts 81, i.e., the press rollers 83 are slightly movable relative to the slidable seat 70, the feeding mechanism of this embodiment is capable of feeding a workpiece 600 whose width is variable to a certain extent. If the width of the workpiece 600 is even larger, the user can move the slidable body 10 of the feeding unit 400 along the main rails 310 of the rail unit 300 through operation of the locking handle 15, and move the slidable seat 70 of the press roller unit 500 along the secondary rails 320 of the rail unit 300 through operation of the control handle 85, thereby confining fittingly the workpiece 600 therebetween.

Figure 9:
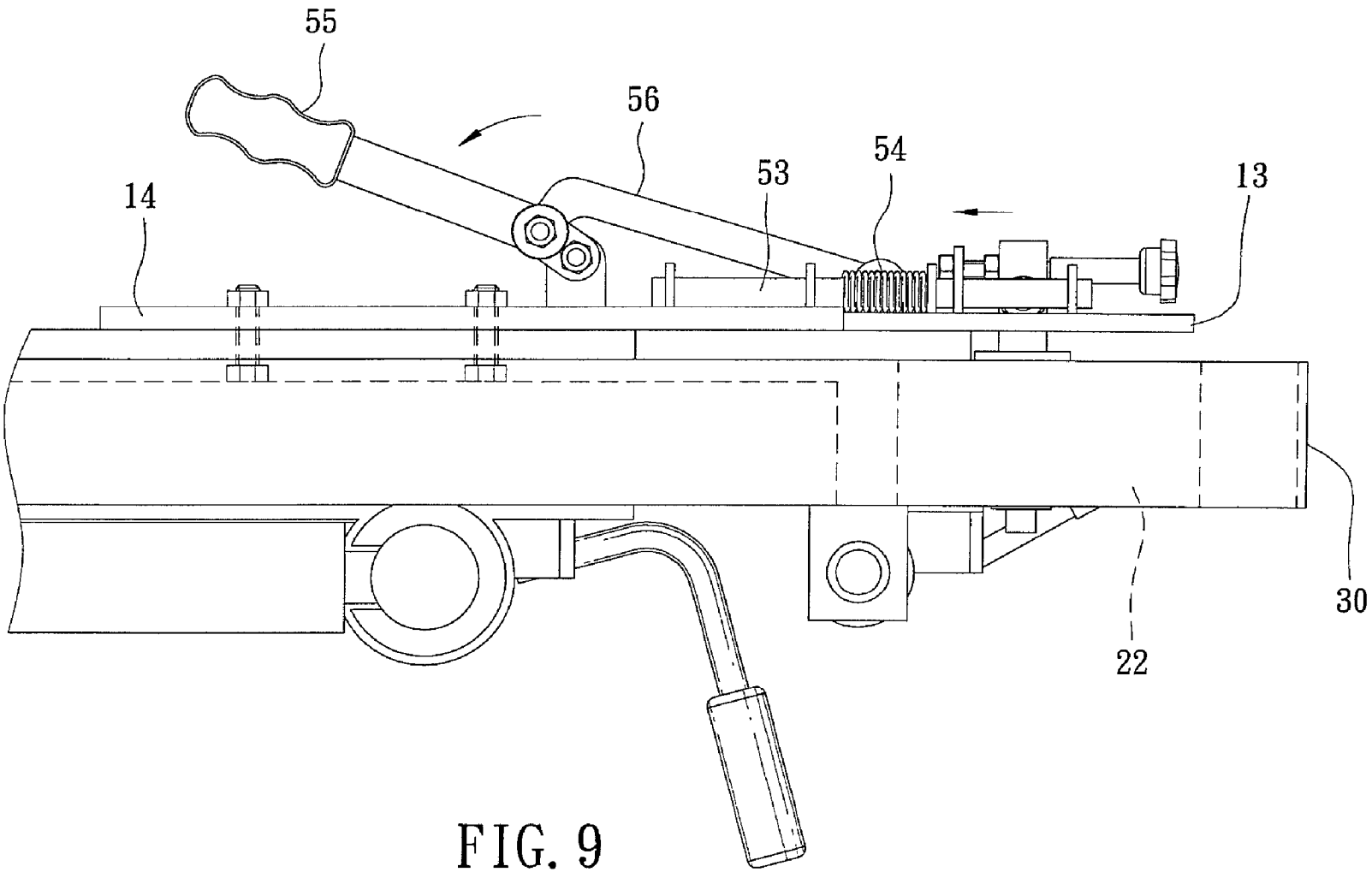
FIG. 9 is a view similar to FIG. 8, but illustrating operation of the distance-adjusting unit.

When the belt component 30 of the feeding unit 400 needs to be replaced, the user can operate the distance-adjusting unit 50 of the feeding unit 400 by pivoting the handle rod 55 away from the second positioning plate 13, as shown in FIG. 9, so that the second positioning plate 13 of the slidable body 10 of the feeding unit 400 moves toward the third positioning plate 14 of the of the slidable body 10 in the second direction (II). Hence, the distance between the second roller 22 and the first roller 21 of the feeding unit 400 is reduced, thereby facilitating the replacement of the belt component 30. After replacing the belt component 30, the user has to pivot the handle rod 55 back to the normal position shown in FIG. 8, so that the second positioning plate 13 is biased by the springs 54 to move along with the second roller 22 away from the third positioning plate 14, and so that the new belt component 30 is eventually retained on the first and second rollers 21, 22. The user can also operate the angle-adjusting unit 60 of the feeding unit 400 via the adjusting screw rod 63 to adjust the tilt of the second roller 22 relative to the second direction (II).

Since the feeding unit 400 and the press roller unit 500 are provided across the worktable 100 of the woodworking machine by virtue of the rail unit 300 disposed on two sides of the worktable 100, the feeding mechanism of this embodiment will not cause the worktable 100 to incline. Moreover, the feeding unit 400 can slide back and forth in the first direction (I) along the main rails 310 without being obstructed.

It should be noted that, while this invention is exemplified using a plurality of fastening members 90 with a plurality of press rollers 83 connected thereto, only one fastening member 90 with one press roller 83 connected thereto may be employed in other embodiments of this invention.

Figure 10:
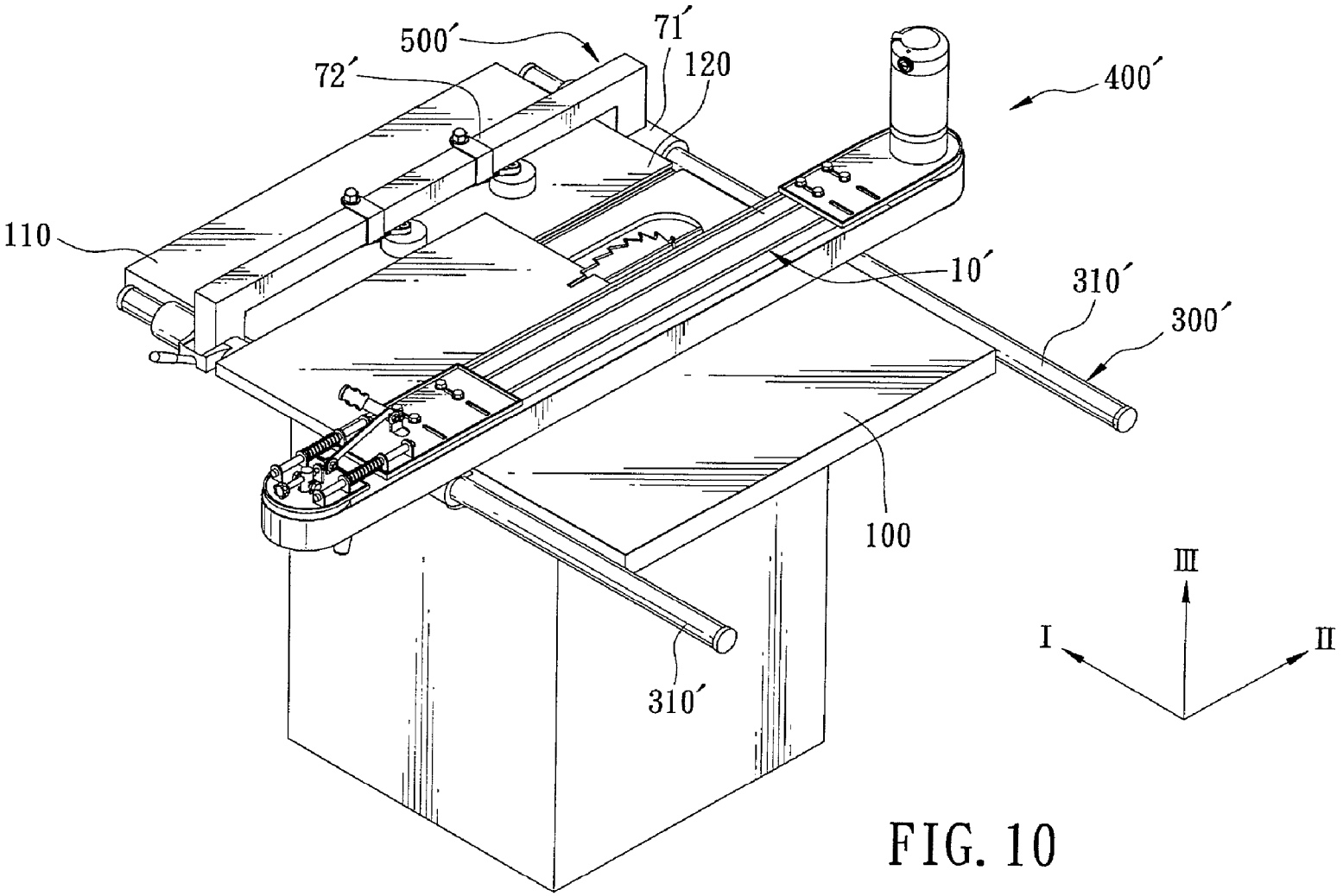
FIG. 10 is a perspective view of a woodworking machine mounted with a second preferred embodiment of a feeding mechanism according to the invention.

As shown in FIG. 10, the second preferred embodiment of the feeding mechanism according to the present invention has a structure similar to that of the first embodiment. The main difference between this embodiment and the previous embodiment resides in the following. The feeding mechanism of the second embodiment comprises a rail unit 300' that includes a pair of parallel main rails 310' extending in the first direction (I) and adapted to be disposed respectively on the workpiece feeding side 110 and the workpiece discharge side 120 of the worktable 100 of the woodworking machine, a feeding unit 400' that includes a slidable body 10' disposed slidably on the main rails 310', and a press roller unit 500' that includes a pair of sleeves 71' sleeved respectively and movably on the main rails 310' and a supporting arm 72' interconnecting fixedly the sleeves 71' and extending across the worktable 100. The second preferred embodiment has the same advantages as those of the first preferred embodiment.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A feeding mechanism adapted for use with a woodworking machine, the woodworking machine including a worktable that is disposed for supporting a workpiece thereon and that has a workpiece feeding side and a workpiece discharge side opposite to the workpiece feeding side, and a cutter that is provided on the worktable between the workpiece feeding side and the workpiece discharge side, said feeding mechanism comprising:

a rail unit adapted to be disposed on the workpiece feeding side and the workpiece discharge side of the worktable and extending along a first direction;

a feeding unit including a slidable body that is adapted to extend across the worktable in a second direction transverse to the first direction, that is disposed slidably on said rail unit, and that has an abutment surface adapted to be perpendicular to the worktable and extending in the second direction, two rollers that are disposed on said slidable body and that are spaced apart from each other in the second direction, a belt component that is trained on said rollers and that abuts against said abutment surface of said slidable body, and a driving component that is disposed for driving said rollers to rotate along with said belt component; and a press roller unit adapted to extend slidably across the worktable in the second direction and including a slidable seat that is disposed slidably on said rail unit, a press roller that is connected pivotally to said slidable seat, and a resilient component that is adapted for biasing said press roller to press the workpiece against said feeding unit.

2. The feeding mechanism as claimed in claim 1, wherein said slidable body of said feeding unit includes an abutment plate on which said abutment surface is formed, a first positioning plate mounted securely on one end of said abutment plate adjacent to the workpiece discharge side of the worktable of the woodworking machine, and a second positioning plate connected movably to the other end of said abutment plate adjacent to the workpiece feeding side of the worktable, said first and second rollers of said feeding units being disposed respectively on said first and second positioning plates.

3. The feeding mechanism as claimed in claim 2, wherein:

said slidable body of said feeding unit further includes a third positioning plate spaced apart from said second positioning plate and mounted securely on the end of said abutment plate adjacent to the workpiece feeding side of the worktable of the woodworking machine; and said feeding unit further includes a distance-adjusting unit operable for driving movement of said second positioning plate relative to said third positioning plate in the second direction, said distance-adjusting unit including two pairs of first lugs provided on said third positioning plate, two pairs of second lugs provided on said second positioning plate, each pair of said second lugs being registered with a respective pair of said first lugs in the second direction, a pair of guide rods disposed securely on said third positioning plate, each of said guide rods extending through a respective pair of said first lugs and a corresponding pair of said second lugs, a pair of springs sleeved respectively on said guide rods, each of said springs being disposed between a respective pair of said first lugs and a corresponding pair of said second lugs, a handle rod having an end connected pivotally to said third positioning plate, and a connecting rod having two ends connected respectively and pivotally to an intermediate portion of said handle rod and said second positioning plate.

4. The feeding mechanism as claimed in claim 2, wherein:

said second roller of said feeding unit has an axle extending through said second positioning plate; and said feeding unit further includes an angle-adjusting unit having a pivot shaft that is provided on said second positioning plate and that extends through said axle of said second roller in the first direction such that said axle is pivotable about said pivot shaft, a lug plate that is disposed securely on said second positioning plate, and an adjusting screw rod extending through and co-movable with an end of said axle of said second roller at a position above said pivot shaft and connected to said lug plate such that movement of said adjusting screw rod relative to said lug plate results in pivoting movement of said axle of said second roller about said pivot shaft.

5. The feeding mechanism as claimed in claim 1, wherein:

said rail unit includes a pair of parallel main rails extending in the first direction and adapted to be disposed respectively on the workpiece feeding side and the workpiece discharge side of the worktable of the woodworking machine, and a pair of secondary rails parallel to said main rails and connected securely and respectively to opposite ends of said slidable body of said feeding unit;

said slidably body is disposed slidably on said main rails; and said slidable seat of said press roller unit includes a pair of sleeves sleeved respectively and movably on said secondary rails, and a supporting arm interconnecting fixedly said sleeves and extending across the worktable.

6. The feeding mechanism as claimed in claim 5, wherein said press roller unit further includes a pivot rod extending in a third direction transverse to the first and second directions and connected to said supporting arm of said slidable seat, and a connecting plate having an end connected to and pivotable about said pivot rod and an opposite end connected pivotally to said press roller, said resilient component being disposed between said connecting plate and said supporting arm.

7. The feeding mechanism as claimed in claim 6, wherein said connecting plate of said press roller unit further has a stop portion abutting against said supporting arm of said slidable seat of said press roller unit.

8. The feeding mechanism as claimed in claim 6, wherein said press roller unit further includes a U-shaped fastening member sleeved fixedly on said supporting arm of said slidable seat and having two ends defining an opening through which said pivot rod extends.

9. The feeding mechanism as claimed in claim 1, wherein:

said rail unit includes a pair of parallel main rails extending in the first direction and adapted to be disposed respectively on the workpiece feeding side and the workpiece discharge side of the worktable of the woodworking machine;

said slidably body is disposed slidably on said main rails; and said slidable seat of said press roller unit includes a pair of sleeves sleeved respectively and movably on said main rails, and a supporting arm interconnecting fixedly said sleeves and extending across the worktable.

10. The feeding mechanism as claimed in claim 9, wherein said press roller unit further includes a pivot rod extending in a third direction transverse to the first and second directions and connected to said supporting arm of said slidable seat, and a connecting plate having an end connected to and pivotable about said pivot rod and an opposite end connected pivotally to said press roller, said resilient component being disposed between said connecting plate and said supporting arm.

11. The feeding mechanism as claimed in claim 10, wherein said connecting plate of said press roller unit has a stop portion abutting against said supporting arm of said slidable seat of said press roller unit.

12. The feeding mechanism as claimed in claim 10, wherein said press roller unit further includes a U-shaped fastening member sleeved fixedly on said supporting arm of said slidable seat and having two ends defining an opening through which said pivot rod extends.

* * * * *